US006624137B1

(12) United States Patent
Katoh et al.

(10) Patent No.: US 6,624,137 B1
(45) Date of Patent: Sep. 23, 2003

(54) SOFTENING FINISH COMPOSITION

(75) Inventors: Tohru Katoh, Wakayama (JP); Yohei Kaneko, Wakayama (JP); Yasuki Ohtawa, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/807,894

(22) PCT Filed: Oct. 26, 1999

(86) PCT No.: PCT/JP99/05913

§ 371 (c)(1),
(2), (4) Date: Jun. 15, 2001

(87) PCT Pub. No.: WO00/24961

PCT Pub. Date: May 4, 2000

(30) Foreign Application Priority Data

Oct. 26, 1998 (JP) ..... 10-303856

(51) Int. Cl.[7] ..... C11D 1/645; C11D 1/835
(52) U.S. Cl. ..... 510/515; 510/499; 510/504
(58) Field of Search ..... 510/499, 504, 510/515

(56) References Cited

U.S. PATENT DOCUMENTS

| | | | | |
|---|---|---|---|---|
| 5,476,597 A | | 12/1995 | Sakata et al. | |
| 5,476,598 A | * | 12/1995 | Schramm, Jr. et al. | 252/8.8 |
| 5,580,481 A | | 12/1996 | Sakata et al. | |
| 5,747,443 A | * | 5/1998 | Wahl et al. | 510/515 |
| 5,880,086 A | | 3/1999 | Weinelt et al. | |
| 6,541,444 B1 | * | 1/2003 | Ohtawa et al. | 510/515 |

FOREIGN PATENT DOCUMENTS

| | | |
|---|---|---|
| EP | 0643128 B1 | 3/1995 |
| EP | 0691396 A2 | 1/1996 |
| JP | 10212665 A | 8/1998 |
| WO | 9964660 | 12/1999 |

* cited by examiner

*Primary Examiner*—John Hardee

(74) *Attorney, Agent, or Firm*—Birch, Stewart, Kolasch & Birch, LLP

(57) ABSTRACT

The present invention provides a softener exhibiting a excellent softening effect and a satisfactory biodegradability. That is, the present invention provides a softener composition comprising the following components (A) and (B):

(A) an amine represented by the formula (I), a salt thereof with an acid or a quaternary product thereof, or a mixture thereof:

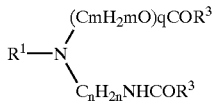

(I)

wherein $R^1$ represents an alkyl or hydroxyalkyl group having 1 to 4 carbon atoms, $—(C_mH_{2m}O)_p—H$ or $—(C_mH_{2m}O)_p—COR^3$; $R^3$ represents a linear or branched alkyl or alkenyl group having 5 to 35 carbon atoms; when $R^1$ is the alkyl or hydroxyalkyl group having 1 to 4 carbon atoms, q is a number selected from 2 to 60; when $R^1$ is $—(C_mH_{2m}O)_p—H$ or $—(C_mH_{2m}O)_p—COR^3$, p is not less than 1 and q is not less than 2, provided that p+q equals 3 to 60; m and n are the same or different and represent 2 to 6; and m in the number of p and m in the number of q may be the same or different and (B) a quaternary ammonium salt represented by the formula (II):

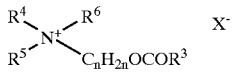

(II)

wherein $R^4$ represents an alkyl group having 1 to 3 carbon atoms; $R^5$ and $R^6$ are the same or different and represent an alkyl group having 1 to 3 carbon atoms, $—C_nH_{2n}OH$ or $—C_nH_{2n}OCOR^3$; $X^-$ represents an anion; and n and $R^3$ have the same meanings as defined above.

2 Claims, No Drawings

SOFTENING FINISH COMPOSITION

TECHNICAL FIELD

The present invention relates to a softener composition.

BACKGROUND ART

Most of the commercially available merchandise as a softener composition for fibers are compositions comprising a quaternary ammonium salt containing two long-chain alkyl groups in one molecule and being typified by a di(long-chain alkyl) dimethyl ammonium chloride.

However, the quaternary ammonium salt described above suffers from the problem that, when residues thereof after a treatment is discharged into the environment such as a river, most of them are accumulated without biodegradation.

As an improved product against the above-mentioned problem, N-methyl-N,N-bis(long-chain alkanoyloxyethyl)-N-(2-hydroxyethyl)ammonium methyl sulfate, N,N-dimethyl-N,N-bis(alkanoyloxyethyl)ammonium chloride or the like is commercially available. Although the biodegradability of the improved product is improved as compared with that of the quaternary ammonium salt described above, the improved product cannot be said to be a base for sufficiently satisfying a softening effect.

For example, JP-A 10-212665 discloses a softener composition comprising a specific tertiary amine compound or a neutralized or quaternary product thereof.

DISCLOSURE OF INVENTION

Accordingly, the object of the present invention is to provide a softener exhibiting an excellent softening effect and a satisfactory biodegradability.

The present invention provides a softener composition comprising the following components (A) and (B):

(A) an amine represented by the formula (I), a salt thereof with an acid or a quaternary product thereof, or a mixture thereof:

(I)

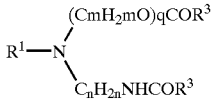

wherein $R^1$ represents an alkyl or hydroxyalkyl group having 1 to 4 carbon atoms, $—(C_mH_{2m}O)_p—H$ or $—(C_mH_{2m}O)_pCOR^3$; $R^3$ represents a linear or branched alkyl or alkenyl group having 5 to 35 carbon atoms; when $R^1$ is the alkyl or hydroxyalkyl group having 1 to 4 carbon atoms, q is a number selected from 2 to 60; when $R^1$ is $—(C_mH_{2m}O)_p—H$ or $—(C_mH_{2m}O)_p—COR^3$, p is not less than 1 and q is not less than 2, provided that the sum of p and q equals 3 to 60; m and n are the same or different and represent 2 to 6; and m in the number of p and m in the number of q may be the same or different; and (B) a quaternary ammonium salt represented by the formula (II):

(II)

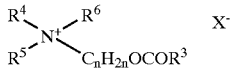

wherein $R^4$ represents an alkyl group having 1 to 3 carbon atoms; $R^5$ and $R^6$ are the same or different and represent an alkyl group having 1 to 3 carbon atoms, $—C_nH_{2n}OH$ or $—C_nH_{2n}OCOR^3$; $X^-$ represents an anion; and n and $R^3$ have the same meanings as defined above.

Further, the present invention relates to use of the above-described composition as a softener. In addition, the present invention relates to a method for softening an article made of fibers with the above-described composition.

Modes for Carrying out the Invention

In the component (A) used in the present invention, it is preferable that n is 2 or 3, m is 2 or 3 and $R^3$ is an alkyl or alkenyl group having 11 to 21 carbon atoms. When the component (A) is a salt with an acid, the acid used may be an inorganic or organic acid, but hydrochloric acid, sulfuric acid, citric acid and glycolic acid are preferable. With regard to the quaternary product, a quaternarizing agent therefor is preferably methyl chloride, dimethyl sulfate or diethyl sulfate.

The amine represented by the formula (I) is produced for example by mono-amidation of an aminoalkyl alkanolamine such as aminoethyl ethanolamine and then adding at least 2 moles of an alkylene oxide such as ethylene oxide and propylene oxide thereto, followed by esterification of the resultant product; or by cyanoethylating a dialkanolamine such as diethanol amine and diisopropanolamine, hydrogenating the cyanoethylated product in order to be a diamine, then amidation of the resultant product and adding at least one mole of an alkylene oxide, followed by esterification of the resultant product. The esterification may be also carried out prior to or simultaneously with the adding the alkylene oxide.

A fatty acid used in the amidation or esterification is preferably, for example, a coconut fatty acid, a tallow fatty acid, a hydrogenated (or hardened) tallow fatty acid, a palm stearic acid or a hydrogenated palm stearic acid. A lower alkyl ester thereof or a fat and/or oil may be also used. The degree of acylation in total is preferably 1 to 3 and more preferably 1.5 to 2.5.

It is preferable in view of improving the softening effect that the component (B) used in the present invention is one member or a mixture of two or more members selected from quaternary ammonium salts represented by the following formulae (III), (IV) and (V).

(III)

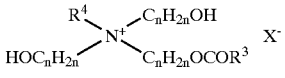

(IV)

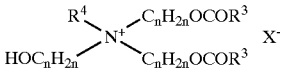

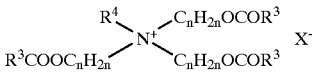

(V)

In the formulae (III), (IV) and (V), n is preferably 2 or 3, and $R^3$ is preferably an alkyl or alkenyl group having 11 to 21 carbon atoms and particularly preferably an alkyl or alkenyl group obtained by removing a carboxyl group from a coconut fatty acid, a tallow fatty acid, a hydrogenated tallow fatty acid, a palm stearic acid or a hydrogenated palm stearic acid. It is preferable that $R^4$ is a methyl group and $X^-$ is a chloride ion or a methyl sulfate ion.

In view of improvement on softening performance or blending stability, the composition of the present invention contains the components (A) and (B) at the ratio of (A)/(B) of preferably from 1/9 to 9/1, more preferably from 4/6 to 8/2 and most preferably from 4/6 to 6/4 by weight.

These components (A) and (B) are preferably formed into the liquid softener by dispersing them in a total amount of 3 to 50% by weight in water. In this case, the components (A) and (B) may be previously mixed and then introduced into water or they may be introduced one after another into water. Alternatively, the respective components may be separately dispersed in water and then mixed.

In order to further improve the dispersibility and/or softening effect, it is preferable that a nonionic surfactant is blended in the composition of the present invention. The nonionic surfactant used is preferably an adduct to a higher alcohol with an alkylene oxide and more preferably an adduct to a $C_{8-22}$ higher alcohol with 5 to 100 moles, particularly 10 to 60 moles, of ethylene oxide. The blended amount of the nonionic surfactant in the composition of the present invention is preferably 0.1 to 10% by weight.

In addition, a higher alcohol or higher fatty acid can be added in order to further improve a softening performance. A lower alcohol such as ethanol and isopropanol, glycol or polyol as well as an ethylene oxide or propylene oxide adduct thereof can be added as a storage stabilizer. Furthermore, an inorganic salt, a pH adjuster, a hydrotropic agent, a perfume, a defoaming agent, a pigment and the like can be added if necessary.

EXAMPLES

Examples 1 to 10

The components (A) and (B) shown in Table 1 were previously molten and then added dropwise to water at 60° C. in which an adduct to lauryl alcohol with 20 moles of ethylene oxide might be dissolved as a nonionic surfactant, followed by adding an acid thereto to prepare each of the softener compositions having the formation shown in Table 1. The softening effect of this composition was evaluated in the following manner. The results are shown in Table 2.

<Method for Evaluating a Softening Effect>

① As a comparative control sample, a 5% dispersion of N-methyl-N,N-bis (tallow alkanoyloxyethyl)-N-(2-hydroxyethyl) ammonium methyl sulfate was prepared in the same manner as described above.

② Treating Method 1 kg of a commercially available cotton towel or 1 kg of a jersey cloth made of acrylate fibers was laundered repeatedly 5 times with a commercially available detergent "Attack" (a registered trade mark, supplied by Kao Corp.) in hard water of 3.5° DH in a laundering machine having its capacity of 30 liter. Then, 25 ml of the softener composition described above were introduced thereinto to treat them under stirring at 25° C. for 1 minute.

③ Method for Evaluating a Softening Effect

The cloth treated in the method described above was air-dried at room temperature and then left in a constant temperature and humidity chamber at 25° C. under 65% RH for 24 hours. The cloth was evaluated for a softening effect. A cloth treated with the comparative control sample was used as the control for evaluation by the paired comparison test. The results are shown using the following criteria.

+2: Softer than the control.

+1: Somewhat softer than the control.

0: Equal in a softening effect to the control.

−1: Somewhat harder than the control.

−2: Harder than the control.

Examples 11 to 14

Each of the softening compositions having the formulation shown in Table 1 was prepared using the components (A) and (B) in Table 1 in the same manner as in Examples 1 to 10 except that no acid was added. The softening effect of this composition was evaluated in the same manner as in Examples 1 to 10. The results are shown in Table 2.

Comparative Examples 1 and 2

Each of the softening compositions having the formulation shown in Table 1 was prepared using only the component (B) in Table 1 in the same manner as in Examples 1 to 10 except that no acid was added. The softening effect of this composition was evluated in the same manner as in Examples 1 to 10. The results are shown in Table 2.

TABLE 1

| No. of Examples | Component (A) | | Component (B) | | | Acid | |
|---|---|---|---|---|---|---|---|
| and Comparative Examples | Kind | Blended amount (% by weight) | Kind | Blended amount (% by weight) | Nonionic surfactant (% by weight) | Kind | Molar ratio to the component (A) |
| Examples | | | | | | | |
| 1 | A-1 | 4 | B-1 | 1 | 1 | Hydrochloric acid | 1.05 |
| 2 | A-1 | 3 | B-1 | 2 | 0 | Hydrochloric acid | 1.05 |
| 3 | A-1 | 3 | B-1 | 2 | 1 | Hydrochloric acid | 1.05 |
| 4 | A-1 | 2 | B-1 | 3 | 1 | Hydrochloric acid | 1.05 |
| 5 | A-1 | 1 | B-1 | 4 | 1 | Hydrochloric acid | 1.05 |
| 6 | A-1 | 3 | B-1 | 2 | 1 | Sulfuric acid | 0.52 |

TABLE 1-continued

| No. of Examples and Comparative Examples | Component (A) Kind | Component (A) Blended amount (% by weight) | Component (B) Kind | Component (B) Blended amount (% by weight) | Nonionic surfactant (% by weight) | Acid Kind | Acid Molar ratio to the component (A) |
|---|---|---|---|---|---|---|---|
| 7 | A-1 | 3 | B-1 | 2 | 1 | Citric acid | 1.15 |
| 8 | A-1 | 3 | B-2 | 2 | 1 | Hydrochloric acid | 1.05 |
| 9 | A-2 | 3 | B-1 | 2 | 1 | Hydrochloric acid | 1.10 |
| 10 | A-2 | 3 | B-2 | 2 | 1 | Hydrochloric acid | 1.10 |
| 11 | A-3 | 3 | B-1 | 2 | 1 | | |
| 12 | A-3 | 3 | B-2 | 2 | 1 | | |
| 13 | A-4 | 3 | B-1 | 2 | 1 | | |
| 14 | A-4 | 3 | B-2 | 2 | 1 | | |
| Comparative Examples | | | | | | | |
| 1 | | | B-1 | 5 | 1 | | |
| 2 | | | B-2 | 5 | 1 | | |

Description of the Abbreviations in Table 1

A-1:

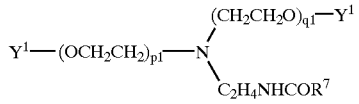

wherein $Y^1$ is a hydrogen atom or —$COR^7$, —$COR^7$ being an acyl group derived from a hydrogenated tallow fatty acid; p1+q1 equals 6; and the degree of acylation in total is 2.1.

A-2:

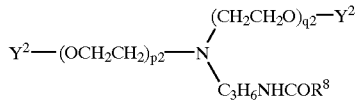

wherein $Y^2$ is a hydrogen atom or —$COR^8$, —$COR^8$ being an acyl group derived from a tallow fatty acid; p2+q2 equals 8; and the degree of acylation in total is 1.9.

A-3: A quaternary product of A-1 by dimethyl sulfate.

A-4: A quaternary product of A-2 by dimethyl sulfate.

B-1: A quaternary product by dimethyl sulfate of a reacted product of triethanolamine with a tallow fatty acid at the molar ratio of 1:2 (with the ratio by weight of monoester diester: triester being 18:45:37).

B-2: A quaternary product by methyl chloride of a reacted product of N-methyldiethanolamine with a hydrogenated tallow fatty acid at the molar ratio of 1:1.8.

TABLE 2

| No. of Examples and Comparative Examples | Results of evaluations for softening effect: Cotton towel | Results of evaluations for softening effect: Jersey cloth made of acrylate fibers |
|---|---|---|
| Examples | | |
| 1 | +2 | +1 |
| 2 | +2 | +1 |
| 3 | +2 | +2 |
| 4 | +2 | +1 |
| 5 | +1 | +1 |

TABLE 2-continued

| No. of Examples and Comparative Examples | Results of evaluations for softening effect: Cotton towel | Results of evaluations for softening effect: Jersey cloth made of acrylate fibers |
|---|---|---|
| 6 | +2 | +2 |
| 7 | +1 | +2 |
| 8 | +2 | +2 |
| 9 | +1 | +2 |
| 10 | +2 | +1 |
| 11 | +2 | +1 |
| 12 | +2 | +2 |
| 13 | +2 | +2 |
| 14 | +2 | +2 |
| Comparative Examples | | |
| 1 | 0 | 0 |
| 2 | +1 | 0 |

What is claimed is:

1. A softener composition comprising the following components (A) and (B):

(A) an amine represented by the formula (I), a salt thereof with an acid or a quaternary product thereof, or a mixture thereof:

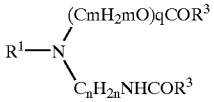

(I)

wherein $R^1$ represents an alkyl or hydroxyalkyl group having 1 to 4 carbon atoms, —$(C_mH_{2m}O)_p$—H or —$(C_mH_{2m}O)_p$—$COR^3$; $R^3$ represents a linear or branched alkyl or alkenyl group having 5 to 35 carbon atoms; when $R^1$ is the alkyl or hydroxyalkyl group having 1 to 4 carbon atoms, q is a number selected from 2 to 60; when $R^1$ is —$(C_mH_{2m}O)_p$—H or —$(C_mH_{2m}O)_p$—$COR^3$, p is not less than 1 and q is not less than 2, provided that the sum of p and q equals 3 to 60; m and n are the same or different and represent 2 to 6; and m in the number of p and m in the number of q may be the same or different; and (B) a quaternary ammonium salt represented by formula (II):

(II)

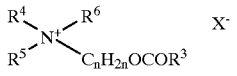

wherein $R^4$ represents an alkyl group having 1 to 3 carbon atoms; $R^1$ and $R^6$ are the same or different and represent an alkyl group having 1 to 3 carbon atoms, —$C_nH_{2n}OH$ or —$C_nH_{2n}OCOR^1$;

$X^-$ represents an anion; and n and $R^3$ have the same meanings as defined above.

2. The softener composition as claimed in the claim 1, wherein the component (B) is one member or a mixture of two or members selected from quaternary ammonium salts represented by the following formulae (III), (IV) and (V):

(III)

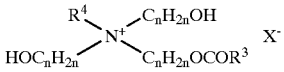

(IV)

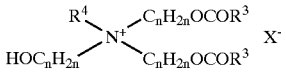

(V)

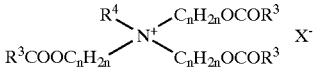

wherein n is 2 or 3, $R^3$ is an alkyl or alkenyl group having 11 to 21 carbon atoms, $R^4$ is a methyl group, and $X^-$ is a chloride ion or a methyl sulfate ion.

* * * * *